US008820420B2

(12) United States Patent
Kuhlman

(10) Patent No.: US 8,820,420 B2
(45) **Date of Patent: *Sep. 2, 2014**

(54) METHOD FOR INCREASING THE RECOVERY OF HYDROCARBONS

(75) Inventor: Myron I. Kuhlman, Houston, TX (US)

(73) Assignee: World Energy Systems Incorporated, Fort Worth, TX (US)

( * ) Notice: Subject to any disclaimer, the term of this patent is extended or adjusted under 35 U.S.C. 154(b) by 35 days.

This patent is subject to a terminal disclaimer.

(21) Appl. No.: 13/346,530

(22) Filed: Jan. 9, 2012

(65) Prior Publication Data

US 2012/0103605 A1 May 3, 2012

Related U.S. Application Data

(63) Continuation of application No. 12/112,487, filed on Apr. 30, 2008, now Pat. No. 8,091,636.

(51) Int. Cl.
*E21B 43/17* (2006.01)
*E21B 43/24* (2006.01)

(52) U.S. Cl.
USPC ..... 166/400; 166/268; 166/401; 166/272.3; 166/272.7; 166/302

(58) Field of Classification Search
None
See application file for complete search history.

(56) References Cited

U.S. PATENT DOCUMENTS

| | | | |
|---|---|---|---|
| 3,794,113 | A | 2/1974 | Strange |
| 4,271,905 | A | 6/1981 | Redford et al. |
| 4,410,042 | A | 10/1983 | Shu |
| 4,565,249 | A | 1/1986 | Pebdani et al. |
| 4,574,884 | A | 3/1986 | Schmidt |
| 4,627,493 | A | 12/1986 | Alameddine |
| 4,699,213 | A | 10/1987 | Fleming |
| 5,055,030 | A | 10/1991 | Schirmer |
| 5,255,742 | A | 10/1993 | Mikus |
| 5,273,111 | A | 12/1993 | Brannan et al. |
| 5,404,952 | A | 4/1995 | Vinegar et al. |

(Continued)

FOREIGN PATENT DOCUMENTS

| | | |
|---|---|---|
| CN | 101122225 | 2/2008 |
| EP | 0 144 203 A2 | 6/1985 |

(Continued)

OTHER PUBLICATIONS

Robert M. Schirmer and Rod L. Eson, A Direct-Fired Downhole Steam Generator—From Design to Field Test, Society of Petroleum Engineers, Oct. 1985, pp. 1903-1908.

(Continued)

*Primary Examiner* — Angela M DiTrani
(74) *Attorney, Agent, or Firm* — Patterson & Sheridan, LLP

(57) ABSTRACT

Embodiments of the invention relate to methods for increasing the recovery of hydrocarbons from a subterranean reservoir. In one embodiment, a method for recovering hydrocarbons from a subterranean reservoir is provided. The method includes positioning a first device into a first horizontal well, injecting a first fluid into the first horizontal well through the first device, producing hydrocarbons from a second horizontal well disposed below the first well, injecting a second fluid into a third well laterally offset from each of the first and second wells to drive fluids in the reservoir toward the second well while continuing to produce hydrocarbons from the second well, and selectively ceasing injection into the first well when the second well is in fluid communication with the third well.

29 Claims, 6 Drawing Sheets

(56) References Cited

U.S. PATENT DOCUMENTS

| | | | | |
|---|---|---|---|---|
| 5,488,990 | A | 2/1996 | Wadleigh et al. | |
| 5,623,576 | A | 4/1997 | Deans | |
| 5,832,999 | A | 11/1998 | Ellwood | |
| 5,862,858 | A | 1/1999 | Wellington et al. | |
| 5,899,269 | A | 5/1999 | Wellington et al. | |
| 6,019,172 | A | 2/2000 | Wellington et al. | |
| 6,257,334 | B1 | 7/2001 | Cyr et al. | |
| 6,269,882 | B1 | 8/2001 | Wellington et al. | |
| 6,358,040 | B1 | 3/2002 | Pfefferle et al. | |
| 6,394,791 | B2 | 5/2002 | Smith et al. | |
| 6,662,872 | B2 | 12/2003 | Gutek et al. | |
| 6,752,623 | B2 | 6/2004 | Smith et al. | |
| 6,973,968 | B2 | 12/2005 | Pfefferle | |
| 7,114,566 | B2 | 10/2006 | Vinegar et al. | |
| 7,341,102 | B2 | 3/2008 | Kresnyak et al. | |
| 7,343,971 | B2 | 3/2008 | Pfefferle | |
| 7,556,099 | B2 | 7/2009 | Arthur et al. | |
| 8,091,636 | B2 * | 1/2012 | Kuhlman | 166/272.3 |
| 2003/0000711 | A1 | 1/2003 | Gutek et al. | |
| 2005/0239661 | A1 | 10/2005 | Pfefferle | |
| 2006/0042794 | A1 | 3/2006 | Pfefferle | |
| 2006/0175061 | A1 | 8/2006 | Crichlow | |
| 2006/0260814 | A1 | 11/2006 | Pfefferle | |
| 2006/0289157 | A1 | 12/2006 | Rao | |
| 2007/0202452 | A1 | 8/2007 | Rao | |
| 2009/0145606 | A1 | 6/2009 | Hocking | |

FOREIGN PATENT DOCUMENTS

| | | | |
|---|---|---|---|
| JP | 57-92298 | | 6/1982 |
| JP | 57-116890 | A | 7/1982 |
| WO | WO-2006/074554 | A1 | 7/2006 |
| WO | WO-2006/074555 | A1 | 7/2006 |
| WO | WO-2009/076763 | A1 | 6/2009 |

OTHER PUBLICATIONS

Don Lyle, CO2 Research Promises Oil Gains, Dec. 1, 2007, pp. 1-5.

PCT Search Report for International Application No. PCT/US2009/041307 dated Dec. 1, 2009.

Comparative Analysis of Stem Delivery Cost for Surface and Downhole Steam Drive Technologies, Sandia national Labs., Albuquerque, NM, Oct. 1981, National Technical Information Services.

Downhole Steam-Generator Study, vol. 1, Conception and Feasibility Evaluation, Final Report, Sep. 1978-Sep. 1980, Sandia National Labs., Albuquerque, NM, Jun. 1982.

Examination Report from Patent Office of the Cooperation Council for the Arab States of the Gulf; Application No. GCC/P/2009/13380; Mailed Feb. 9, 2013.

Chinese Office Action for Application No. 200980125300.X dated Mar. 1, 2013.

* cited by examiner

METHOD FOR INCREASING THE RECOVERY OF HYDROCARBONS

CROSS-REFERENCE TO RELATED APPLICATIONS

This application is a continuation of U.S. patent application Ser. No. 12/112,487, filed Apr. 30, 2008, which issued as U.S. Pat. No. 8,091,636 on Jan. 10, 2012, which is hereby incorporated by reference herein.

BACKGROUND OF THE INVENTION

1. Field of the Invention

Embodiments of the invention generally relate to methods for increasing the recovery of hydrocarbons from a subterranean reservoir.

2. Description of the Related Art

Oil can generally be separated into classes or grades according to its viscosity and density. Grades of oil that have a high viscosity and density may be more difficult to produce from a reservoir to the surface. In particular, extra heavy oil requires enhanced oil recovery techniques for production. In the following description, the generic term "oil" includes hydrocarbons, such as extra heavy oil, as well as less viscous grades of oil.

A large portion of the world's potential oil reserves is in the form of heavy or extra heavy oil, such as the Orinoco Belt in Venezuela, the oil sands in Canada, and the Ugnu Reservoir in Northern Alaska. Currently, some existing oil reservoirs are exploited using enhanced thermal recovery techniques or solvent-based techniques resulting in a recovery efficiency in the range of 20% to 25%. The most common thermal technique is steam injection by which heat enthalpy from the steam is transferred to the oil by condensation. The heating reduces the viscosity of the oil to allow gravity drainage and collection. Thus, oil recovery is high if the temperature can be maintained near the temperature of the injected steam. Well-known methods such as Cyclic Steam Simulation ("CSS"), Drive Well Injection ("Drive"), and Steam Assisted Gravity Drainage ("SAGD") may be used to recover oil in the above noted potential reserves.

The CSS method utilizes a single vertical well. Steam is injected into the well from a steam generator at the surface. After allowing the reservoir to soak with the steam for a selected amount of time, the oil is then produced from the same well. When production declines, this process is simply repeated. Further, a pump may be required to pump the heated oil to the surface. If so, the pump is often removed each time the steam is injected, and then replaced after the injection.

The Drive method utilizes a vertical well, known as a drive or injector well, and a laterally spaced nearby well, known as a production well. Steam is continuously injected into the drive well from a steam generator at the surface to heat the oil in the surrounding reservoir. The steam front then drives the heated oil into the production well for production.

The SAGD method utilizes two horizontal wells, one well disposed above and parallel to the other. The upper well is known as the injector well and the lower well is known as the production well. Each well may have a slotted liner. Steam is continuously injected into the upper well to heat the oil in the surrounding reservoir. The steam, with the assistance of gravity, causes the oil to flow and drain into the lower well. The oil is then produced from the lower well to the surface.

These methods have many advantages and disadvantages. As the number of potential oil reservoirs increases and the complexity of the operating conditions of these reservoirs increases, there is a continuous need for more efficient enhanced oil recovery techniques and methods.

SUMMARY OF THE INVENTION

The invention relates to a combined steam assisted gravity drainage and drive method of producing oil from a subterranean reservoir. An embodiment includes the use of downhole steam generators or other downhole mixing devices to increase oil production. A further embodiment includes the use of excess carbon dioxide and oxygen to increase oil recovery.

In one embodiment, a method for recovering hydrocarbons from a subterranean reservoir is provided. The method includes positioning a first device into a first horizontal well, injecting a first fluid into the first horizontal well through the first device, producing hydrocarbons from a second horizontal well disposed below the first well, injecting a second fluid into a third well laterally offset from each of the first and second wells to drive fluids in the reservoir toward the second well while continuing to produce hydrocarbons from the second well, and selectively ceasing injection into the first well when the second well is in fluid communication with the third well.

In another embodiment, a method for recovering hydrocarbons from a subterranean reservoir is provided. The method includes injecting steam into a first horizontal well, producing hydrocarbons from a second horizontal well disposed below the first well, injecting steam, carbon dioxide, and oxygen into a third well laterally offset from each of the first and second wells while continuing to produce hydrocarbons from the second well, and selectively ceasing injection into the first well when the second well is in fluid communication with the third well.

In another embodiment, A method for recovering hydrocarbons from a subterranean reservoir is provided. The method includes positioning a first device into a first horizontal well, injecting a first fluid at an initial pressure into the first horizontal well through the first device, producing hydrocarbons from a second horizontal well disposed below the first well, positioning a second device into a third well laterally offset from each of the first and second wells, injecting a second fluid into the third well through the second device to drive fluids in the reservoir toward the second well while continuing to produce hydrocarbons from the second well, selectively ceasing injection into the first well when the second well is in fluid communication with the third well, and increasing the pressure in the first well to at least the initial injection pressure using an injection pressure from the third well.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited aspects of the invention can be understood in detail, a more particular description of embodiments of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to methods for increasing the recovery of oil from a reservoir. According to one embodiment, the use of a combination of a SAGD and a Drive operation, with the use of downhole steam generators ("DHSG") or other downhole mixing devices, excess carbon dioxide, and excess oxygen is provided. As set forth herein, the invention will be described as it relates to DHSGs. It is to be noted, however, that aspects of the invention are not limited to use with DHSGs, but are equally applicable to use with other types of downhole mixing devices. To better understand the novelty of the invention and the methods of use thereof, reference is hereafter made to the accompanying drawings.

Figure 1:
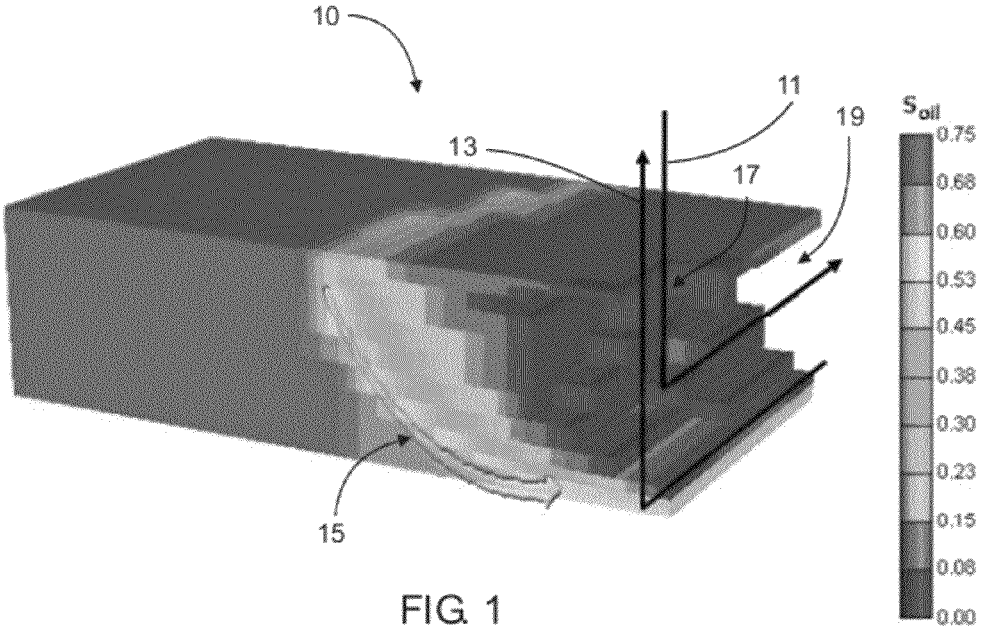
FIG. 1 is a SAGD operation.

FIG. 1 shows a SAGD operation 10. The SAGD operation 10 is a method used to produce low-mobility oil by reducing the oil's viscosity enough for the oil to drain by gravity down the sides of a steam chest 19 to a production well 13 placed at the bottom of a reservoir. The SAGD operation 10 includes an injector well 11 positioned above the production well 13, each of the wells including a horizontal trajectory. The distance between the horizontal trajectories of each well may widely vary depending on conditions of the reservoir. In one embodiment, a range of the distance between the SAGD injector well 11 and the production well 13 is about 26 feet to about 38 feet. In an alternative embodiment, the range of the distance between the wells is about 15 feet to about 50 feet. The draining oil 15 generated during the SAGD operation 10 empties into the production well 13. A DHSG 17 (more fully discussed below) may be located at the heel of the injector well 11. An advantage of the SAGD operation 10 generally includes an accelerated initial rate of oil production.

As shown in FIG. 1, the oil saturation ($S_{oil}$) immediately surrounding the horizontal trajectory of the injector well 11 and above the horizontal trajectory of the production well 13 ranges from about zero to about 9 percent. The oil saturation incrementally increases as the distance from the SAGD operation 10 increases; the range includes about 9 percent nearest the wells 11 and 13 to about 75 percent farthest from the wells 11 and 13. Also, the oil saturation range from about zero to about 30 percent extends farther away from the SAGD operation 10 at the top of the formation, relative to the bottom, forming a downward sloping saturation profile. Gravity drainage contributes to the sloping saturation profile since the draining oil 15 is directed from an elevated position to a lower position where the production well 13 is located.

Figure 2:
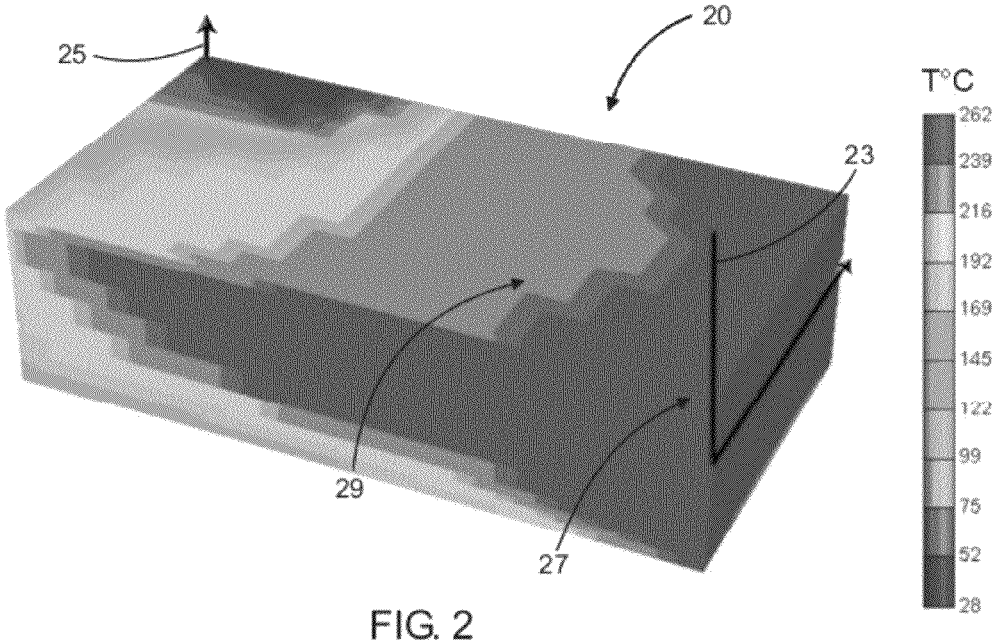
FIG. 2 is a Drive operation.

FIG. 2 shows a Drive operation 20. The Drive operation 20 is a method used to produce higher-mobility oil where steam injected into the reservoir can travel a distance, form a steam chest 29, and produce oil via the combination of gravity segregation from the steam chest 29 and hot water flooding (formed by condensation of steam in the reservoir) of the oil towards a production well 25 placed at the bottom of the reservoir. The Drive operation 20 includes a drive or injector well 23 laterally spaced apart from the production well 25, each of the wells including a horizontal trajectory. In an alternative embodiment, the injector well 23 includes a vertical trajectory only. The lateral distance between the wells may widely vary depending on conditions of the reservoir. In one embodiment, the lateral distance between Drive injector well 23 and the production well 25 is less than about 500 feet. In an alternative embodiment, a range of the lateral distance between the wells is about 500 feet to about 700 feet. A DHSG 27 may be located at the heel of the injector well 23. An advantage of the Drive operation 20 generally includes an increase in ultimate oil production.

As shown in FIG. 2, the temperature immediately surrounding the injector well 23 is in the range of about 239-262 degrees Celsius, which forms a thermal gradient that extends from the horizontal trajectory of the injector well 23 to the horizontal trajectory of the production well 25. The thermal gradient incrementally decreases in temperature near the top and, even more quickly, near the bottom of the formation. The temperature range includes about 262 degrees Celsius nearest the injector well 23 to below about 28 degrees Celsius nearest the production well 25. The coolest temperature in the formation is at the vertical trajectory of the production well 25, i.e. below about 52 degrees Celsius. Depending on the conditions of the wells and the temperature of the injected fluids into the wells, the temperature range may extend above and below the 28-262 degree Celsius temperature range.

The DHSG is designed to generate, exhaust, and inject high temperature steam, as well as other gases, such carbon dioxide and excess oxygen, into a well. A burner disposed in the DHSG is used to combust fuel and heat fluids, such as water, that are supplied to the burner from the surface. The DHSG has the advantage of generating steam and other gases downhole rather than at the surface. This advantage may be evidenced by an example in which a formation contains a permafrost layer between the surface and the oil reservoir or the reservoir is below a cold ocean floor, and hot gases injected from the surface might melt the permafrost or gas hydrates in bottom sediments, causing them and the surrounding formation to expand and potentially collapse the drilled wells. If melting of permafrost or heat losses are not a concern, then the several fluids discussed can be mixed in a downhole mixing device such as a static mixer.

Carbon dioxide can be a very beneficial additive to steam when injected into an oil reservoir. High concentrations of carbon dioxide can accelerate initial oil production from a SAGD operation and can help produce oil faster in a SAGD or Drive operation. Carbon dioxide may also be used to cool the burner in the DHSG. Finally, depending on the conditions of an oil reservoir, carbon dioxide in a liquid state is very soluble in lower temperature oil.

Oxygen is also a very beneficial additive to some thermal enhanced oil recovery operations. Excess oxygen may combust any hot residual oil near the DHSG and may eliminate any carbon monoxide, which is not very soluble in oil, generate carbon dioxide, which is very soluble in cooler oil, and prevent coke generation that can plug the formation. In addition, the oxygen may generate extra energy from combustion of oil in the reservoir and steam from water in the reservoir.

Figure 3:
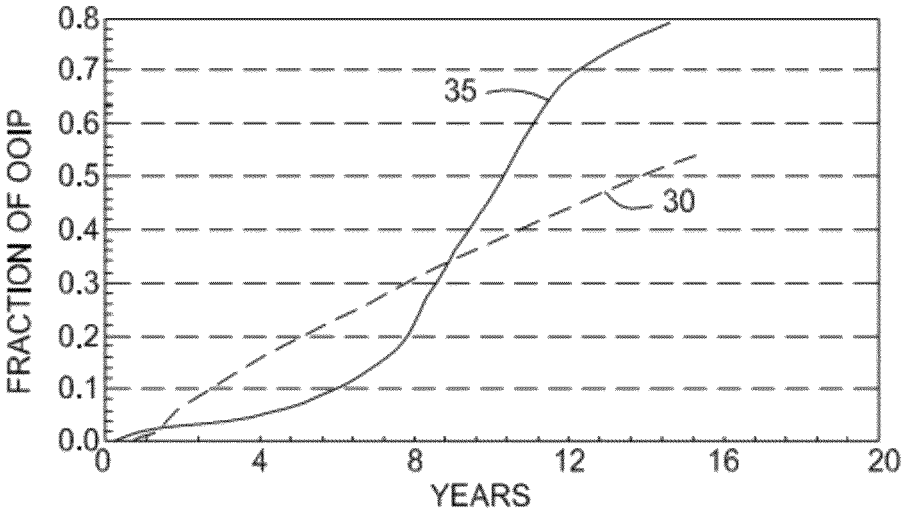
FIG. 3 is a comparison of the SAGD and the Drive operations.

FIG. 3 shows a comparison of original oil in place ("OOIP") recovery between a SAGD operation 30 and a Drive operation 35. The Drive operation 35 includes a 165 foot spacing between the Drive injector and production well. The initial rate of oil production from the SAGD operation 30 is higher than that of the Drive operation 35 because the oil is hot, has a low viscosity, and has to move a short distance between the injector well and the production well compared to the drive well and the production well in the Drive operation 35. The oil production from the SAGD operation 30 is greater than the Drive operation up to the first 8-11 years of production. During this time period, each of the operations may have produced between about 30-40 percent of the OOIP. Beyond the 8-11 year range, the ultimate oil production from the Drive operation 35 is higher than the SAGD operation 30, because the ultimate production from the SAGD operation 30 is limited by the rate at which oil will drain down the edges of the steam chest 19 and the nearly horizontal flow of liquid near the production well 13 of the SAGD operation 30, as shown in FIG. 1. After about 15 years, the Drive operation 35 may have produced about 70-80 percent of the OOIP and the SAGD operation 30 may have produced about 50-60 percent of the OOIP. For less viscous oil, the SAGD operation 30 may initially produce less oil than the Drive operation 35, due to a quickly attained high steam to oil ratio ("SOR") by the closer spaced injector and production wells. In one embodiment, a threshold for the SOR is an incremental 5:1 ratio. The incremental SOR may be calculated for a specific time period, such as a monthly time period. Thus, depending on the conditions of a particular reservoir, it may be beneficial to combine the two types of operations while utilizing DHSGs, as well as carbon dioxide and oxygen.

To begin, one example of a combined SAGD/Drive/DHSG operation will be described. The SAGD section has a horizontal injector well and a horizontal production well disposed below the injector well, and the Drive section has a horizontal injector well laterally spaced apart from the SAGD wells. The combined operation may start with injecting steam into the SAGD injector well via a first DHSG. In an alternative embodiment, the combined operation may start with injecting carbon dioxide into the SAGD injector well via the first DHSG. In an alternative embodiment, oxygen may be injected into the SAGD injector well with steam and/or carbon dioxide. Since carbon dioxide may be rapidly produced by oxidation of oil in the reservoir and by extraction from other gases in the reservoir, it can be recycled and little additional carbon dioxide may be needed. Also, the recycled carbon dioxide can collect significant quantities of natural gas from the reservoir, as well as carbon monoxide and hydrogen generated by reactions in the reservoir. This recycled gas mixture may be utilized as a fuel for the DHSG and may supply a significant amount of the energy needed for the entire operation. Production from the SAGD production well may begin after injection into the SAGD injector well. After a first selected amount of time, a second DHSG may be started at the Drive injector well by which steam is injected. In an alternative embodiment, carbon dioxide is injected into the Drive injector well. In an alternative embodiment, carbon dioxide is injected into the Drive injector well with steam. The injected carbon dioxide may move ahead of a thermal front created by the steam and reduce the oil's viscosity in the reservoir before the steam heats the oil. Thus, the oil's viscosity is reduced by both heating and dilution. In an alternative embodiment, oxygen may be injected into the Drive injector well with the steam and/or the carbon dioxide. When the steam, and if added, the carbon dioxide and/or oxygen, from the Drive injector well establishes fluid communication with the SAGD production well, the SAGD injector well selectively may be shut in. In one embodiment, the SAGD injector well may be shut in when the pressure in the SAGD injector well reaches a particular threshold, such as the initial injection pressure of the SAGD injector well (further discussed below), after fluid from the Drive injector well establishes fluid communication with the SAGD production well. Once injection into the SAGD injector well ceases, the Drive injector well may continue to operate until the SOR reaches a particular threshold, such as an incremental 5:1 ratio. Depending on the conditions of the reservoir, the carbon dioxide may be in a liquid state, which is very soluble in lower temperature oil. Under this combined method, the SAGD/Drive/DHSG operation is capable of producing more oil and accelerating initial production rates more than other methods.

An alternative embodiment of the combined SAGD/Drive/DHSG operation will be described. A first fluid may be injected into the SAGD injector well via a DHSG. The SAGD injector well may include an initial injection pressure. In one embodiment, the initial injection pressure is 1500 pounds per square inch (psi). Production from the SAGD production well may commence after injection into the SAGD injector well. The SAGD production well comprises a volume and pressure limit, wherein the volume helps maintain the production pressure in the SAGD production well. In one embodiment, the SAGD production well has a bottom-hole production pressure of 800 psi. A second fluid may be injected into the Drive injector well via a DHSG. The Drive injector well may also include an initial injection pressure. In one embodiment, the Drive injector well initial injection pressure is 1750 psi. As production from the SAGD production well continues, the bottom-hole pressure in the SAGD injector well may decrease until it reaches the production pressure limit in the SAGD production well. After fluid communication is established between the Drive injector well and the SAGD production well, the bottom-hole pressure in the SAGD injector well may be increased by the initial injection pressure from the Drive injector well since the volume of liquids produced from the SAGD producer is limited. The SAGD injector well selectively may be shut in when the bottom-hole pressure in the SAGD injector well is increased back to its initial injection pressure. In an alternative embodiment, the SAGD injector well selectively may be shut in when the bottom-hole pressure in the SAGD injector well is increased above its initial injection pressure. Finally, the bottom-hole pressure in the Drive injector well may eventually decrease to the production pressure limit in the SAGD production well. The first and second fluids may comprise steam, carbon dioxide, oxygen, or combinations thereof.

Figure 4:
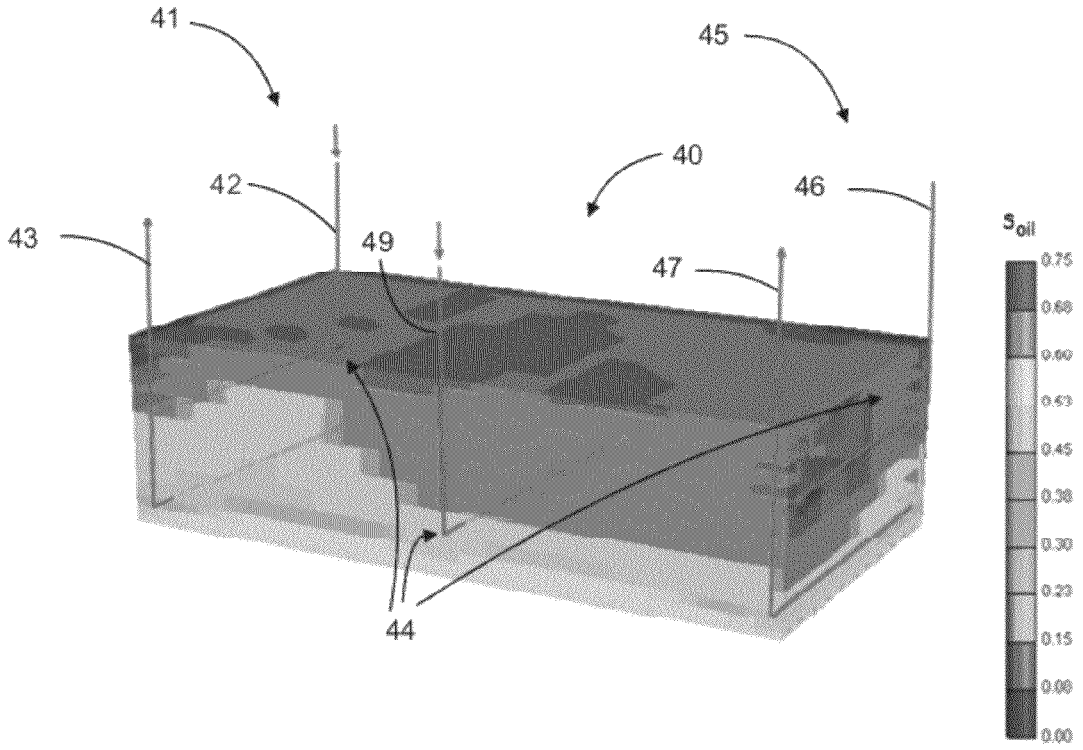
FIG. 4 is a SAGD/Drive/DHSG operation.

FIG. 4 shows one embodiment of a SAGD/Drive/DHSG operation 40. The operation 40 includes a first SAGD operation 41 with an injector well 42 disposed above a production well 43, a second SAGD operation 45 with an injector well 46 disposed above a production well 47, and a Drive injector well 49 laterally disposed between the first and second SAGD operations 41 and 45. Each of the wells includes a horizontal trajectory. DHSGs 44 are similarly positioned in the heels of the injector wells 42, 46, and 49. As shown, the oil saturation across the formation from the SAGD operations 41 to the SAGD operation 45, with the Drive injector well 49 disposed between, is less than about 15 percent. Below the production wells 43 and 47, the oil saturation is in a range of about 23 percent to about 60 percent. The oil saturation in the operation 40 is much lower and includes a larger area when compared to the single SAGD operation 10 as shown in FIG. 1.

In one embodiment, a method for increasing the recovery of hydrocarbons from a subterranean reservoir may include two SAGD operations and a Drive operation. The SAGD operations may be laterally spaced apart and each of the operations include a SAGD injector well and a SAGD production well. A fluid may be injected into a first SAGD injector well. The production of hydrocarbons may begin from a first SAGD production well disposed below the first injector well. A second fluid may be injected into a second SAGD injector well. The production of hydrocarbons may begin from a second SAGD production well disposed below the second injector well. Steam may be injected into a Drive well laterally offset from and disposed between the SAGD operations, while continuing to produce hydrocarbons from the production wells. The injection into the SAGD injector wells may cease when the steam from the Drive well reaches each of the production wells, respectively. The first and second fluids may comprise steam, carbon dioxide, oxygen, or combinations thereof. DHSGs may be disposed in each of the SAGD injector wells and the Drive well. In an alternative embodiment, carbon dioxide and/or oxygen may be injected into the Drive well with the steam. In an alternative embodiment, carbon dioxide and/or steam may be generated downhole (with a DHSG) in the SAGD injector wells and the Drive well.

In an alternative embodiment, a method for increasing the recovery of hydrocarbons from a subterranean reservoir may include injecting the first fluid into the first SAGD injector well via the DHSG at a first initial injection pressure. The second fluid may be injected into the second SAGD injector well via the DHSG at a second initial injection pressure. Production from the first and second SAGD production wells may begin at a first and second production pressure, respectively. The wellhead pressures of the SAGD injector wells may decrease to the production pressures of the relative SAGD production well. A third fluid may be injected into the Drive injector well at a third initial injection pressure. In one embodiment, after fluid communication is established between the Drive injector well and the first SAGD production well, the first SAGD injector well selectively may be shut in because it is no longer needed. In an alternative embodiment, after fluid communication is established between the Drive injector well and each of the SAGD production wells, each of the relative SAGD injector wells selectively may be shut in. The first or second SAGD injector well may be shut in when the wellhead pressure in the first or second SAGD injector well is greater than or equal to its initial injection pressure, respectively. The first, second, and third fluid may comprise steam, carbon dioxide, oxygen, or combinations thereof.

Figure 5:
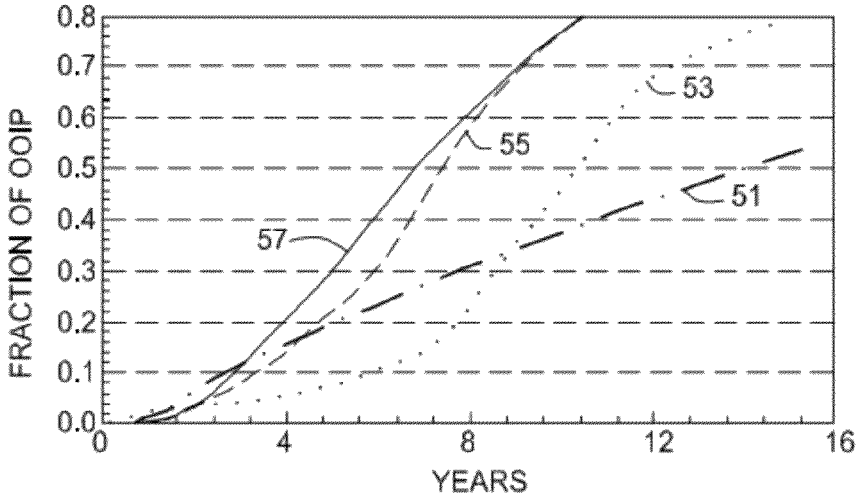
FIG. 5 is a comparison of the SAGD, Drive, and combined operations.

FIG. 5 shows a comparison of the following: (1) a SAGD operation 51 including an injector well disposed above a production well, (2) a Drive operation 53 including an injector well laterally spaced 165 feet from a production well, (3) a SAGD/Horizontal Drive operation 55 including a SAGD operation with an injector well disposed above a production well, and a Drive injector well laterally spaced 165 feet from the SAGD wells, wherein the Drive injector well comprises a horizontal trajectory, and (4) a SAGD/Vertical Drive operation 57 including a SAGD operation with an injector well disposed above a production well, and a Drive injector well laterally spaced 165 feet from the SAGD wells, wherein the Drive injector well comprises a vertical trajectory only. The supplied steam contains 5.65 mole percent of carbon dioxide. The figure shows accelerated initial production from both the SAGD/Horizontal Drive operation 55 and the SAGD/Vertical Drive operation 57, in the range of about 15-25 percent production of the OOIP after 3-6 years. The figure also shows that after about 10 years, twice as much oil is produced with either SAGD/Drive operations 55 and 57 than with the SAGD operation 51 alone, about 75-85 percent OOIP production versus 35-45 percent OOIP production. The figure further shows that the SAGD/Vertical Drive operation 57 produces oil faster than the SAGD/Horizontal Drive operation 55; a result driven by the fact that the steam from the vertical injector well may reach the SAGD production well sooner. In one example, four vertical Drive injector wells may be needed to inject as much steam as a single horizontal Drive injector well, thus, the production per vertical well may be lower.

Figure 6:
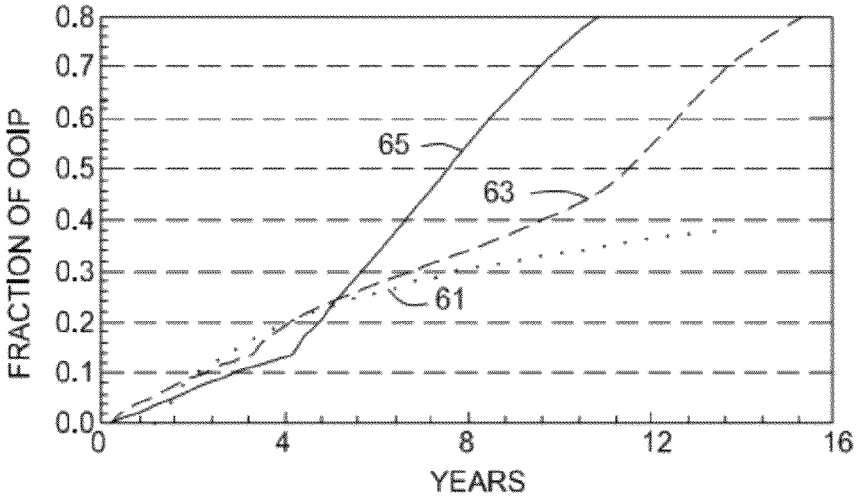
FIG. 6 is a comparison of the effect of excess carbon dioxide and oxygen introduced into the SAGD/Drive operation.

FIG. 6 shows the effect of excess carbon dioxide and excess oxygen introduced into a SAGD/Drive operation, with and without a DHSG or other downhole mixing device. A first operation 61 is a SAGD/Drive operation with a 330 foot spacing between the SAGD and the Drive that includes the use of steam only with vacuum insulated tubing to reduce condensation of the steam. A second operation 63 is a SAGD/Drive operation with a 330 foot spacing between the SAGD and the Drive that includes the use of steam and 20 mole percent of carbon dioxide with vacuum insulated tubing to reduce condensation of the steam. A third operation 65 is a SAGD/Drive/DHSG operation with a 330 foot spacing between the SAGD and the Drive that includes the use of steam, 20 mole percent of carbon dioxide, and 5 mole percent of oxygen. As shown, the third operation 65, operating the DHSG with oxygen and carbon dioxide accelerates oil production. The excess carbon dioxide may serve as a coolant for the burner of the DHSG. The second operation 63 shows that about 80 percent of the OOIP is produced when excess carbon dioxide is added using vacuum insulated tubing over a 15-year period. About 38 percent of the OOIP is produced by the first operation 61 using steam only with vacuum insulated tubing over a similar period. As compared to FIG. 5, the third operation 65, i.e. SAGD/Drive operation with a 330 foot spacing and using 20 mole percent excess carbon dioxide and 5 mole percent oxygen, shows that oil is produced as quickly as from the SAGD/Horizontal Drive operation 55 with a 165 foot spacing and using 5.65 mole percent of carbon dioxide. Therefore, fewer injection pairs may be used when introducing excess carbon dioxide and oxygen into the DHSG.

Figure 7:
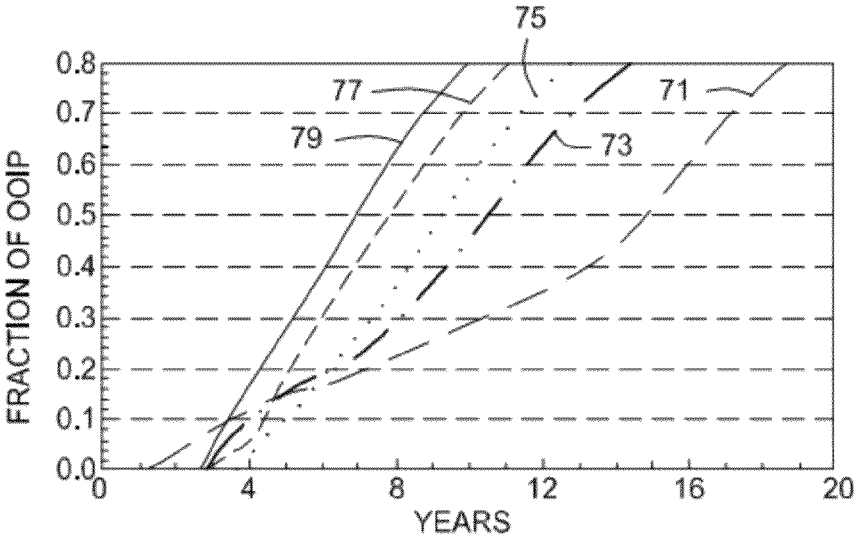
FIG. 7 is a comparison of the effect of excess carbon dioxide introduced into the SAGD/Drive/DHSG operation.

FIG. 7 shows the effect of excess carbon dioxide and oxygen injected from a DHSG or other downhole mixing device in a SAGD/Drive operation with a 330 foot spacing between the SAGD and the Drive. The first operation 71 includes 5.65 mole percent of carbon dioxide only, i.e. no excess oxygen. The second operation 73 includes 5.65 mole percent of carbon dioxide, 5 mole percent of oxygen in the Drive, and 3 mole percent in the SAGD. The third operation 75 includes 15.65 mole percent of carbon dioxide and 5 mole percent of oxygen. The fourth operation 77 includes 25.65 mole percent of carbon dioxide and 5 mole percent of oxygen. The fifth operation 79 includes 35.65 mole percent of carbon dioxide and 5 mole percent of oxygen. As shown, increasing the concentration of carbon dioxide and excess oxygen indicates accelerated oil production. The initial production may be delayed because the DHSG is started with a stoichiometric flame that does not contain excess oxygen, but does contain carbon monoxide, so that oxygen is not injected until the oil is heated to a temperature hot enough to consume oxygen. When excess carbon dioxide is introduced, the delay decreases and the oil production is accelerated. The fifth operation 79 may be shut in several years prior to the second and first operations, 73 and 71 respectively, due to quickly reaching a high SOR threshold because of the addition of the excess carbon dioxide and oxygen levels.

From the examples cited above, it is shown that production from a SAGD/Drive operation can be accelerated with excess carbon dioxide and oxygen. As a result, the well spacing between the SAGD wells and the SAGD/Drive wells may be increased, thus requiring fewer drilled wells. The excess carbon dioxide is beneficial because it is very soluble in unheated oil. The solubility of carbon dioxide in oil may be even higher if the temperature of the oil is less than 80 degrees Fahrenheit and the pressure in the reservoir is maintained above 800 psi. Under these operating conditions, the carbon dioxide is a dense liquid that is very soluble in oil and performs as supercritical carbon dioxide does at higher pressures and temperatures. In addition, the excess oxygen is also beneficial because it helps eliminate carbon monoxide and generate carbon dioxide, provides extra steam, and prevents coke formation.

Figure 8:
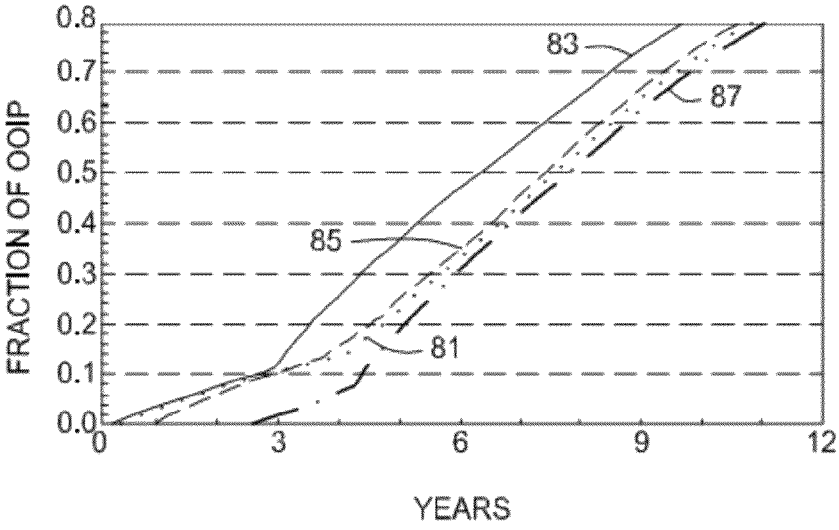
FIG. 8 is a comparison of the effect of injection well spacing in the SAGD operation.

FIG. 8 shows the effect of the spacing between a SAGD injector well and a production well. A first spacing 81 includes a 22 foot spacing between the injector well and the production well. A second spacing 83 includes a 28 foot spacing between the injector well and the production well. A third spacing 85 includes a 33 foot spacing between the injector well and the production well. A fourth spacing 87 includes a 43 foot spacing between the injector well and the production well. As shown, the initial production is delayed the greatest, beyond 2 years, when the injector well and production well are spaced 43 feet apart. This delay decreases as the wells are spaced closer together, producing within a year of beginning the operation. According to this example, the optimum spacing between the wells is 28 feet.

Figure 9:
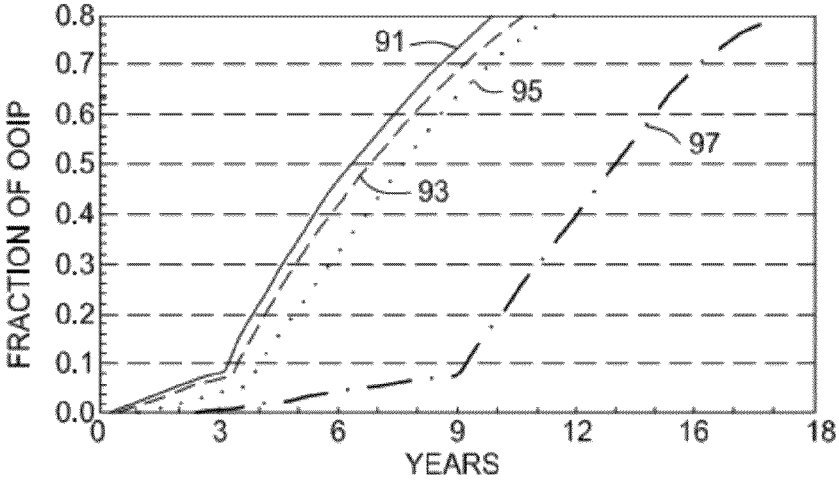
FIG. 9 is a comparison of the effect of oil viscosity in the SAGD/Drive/DHSG operation.

FIG. 9 shows the effect of the viscosity of oil when using a SAGD/Drive/DHSG operation having a 330 foot spacing between the SAGD and the Drive and having a 28 foot spacing between the injector well and production well of the SAGD. A first operation 91 is conducted with oil that has a viscosity of 126,000 centipoise. A second operation 93 is conducted with oil that has a viscosity of 238,000 centipoise. A third operation 95 is conducted with oil that has a viscosity of 497,000 centipoise. A fourth operation 97 is conducted with oil that has a viscosity of 893,000 centipoise. As shown, there is little difference in production between oil with a viscosity of 126,000 centipoise and 497,000 centipoise. The lower viscosity oils provide a rapid increase in oil production after about the third year of operation, with less than about 10 percent OOIP production within the first two to four years to over about 40 percent OOIP production after the fifth year. If the oil includes a viscosity of 893,000 centipoise, then the spacing between all of the wells may need to be located closer together. Conversely, the lower the oil's viscosity, then the spacing between all of the wells may be larger.

Figure 10:
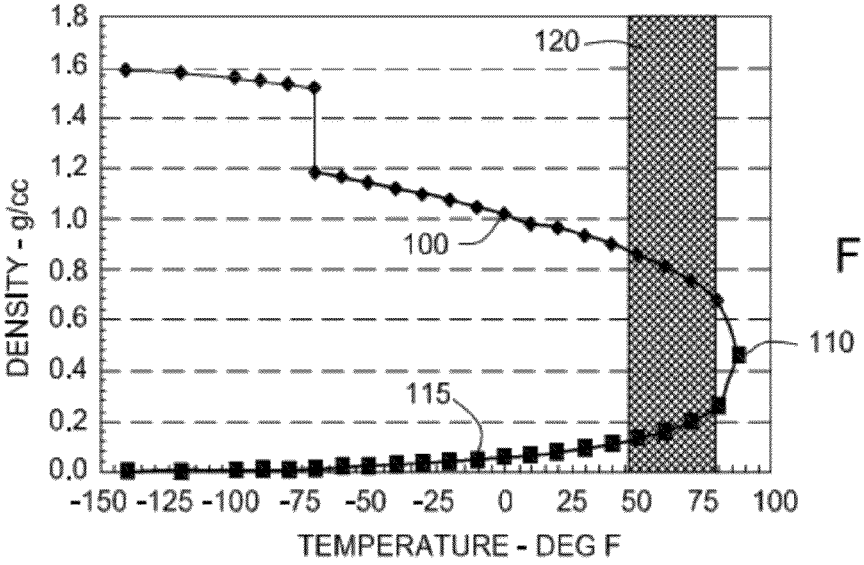
FIG. 10 is a density versus temperature diagram of carbon dioxide.

FIG. 10 shows a density versus temperature diagram of carbon dioxide. Carbon dioxide may be a dense liquid at lower reservoir pressures, such as below 1000 psi, and temperatures below 88 degrees Fahrenheit. As shown, carbon dioxide may be in a liquid state 100 within a temperature range below 88 degrees Fahrenheit and a density range of about 1.2 to about 0.7 grams per cubic centimeter. The critical point 110 for carbon dioxide, i.e. the temperature and pressure at which carbon dioxide switches into a gas state, is about 88 degrees Fahrenheit and about 1,100 psi. The gas state 115 of carbon dioxide may exist below about 88 degrees Fahrenheit with a density below less than 0.2 grams per cubic centimeter. In low viscosity oils, carbon dioxide may be miscible in the oil even though it is not supercritical. In high viscosity oils, carbon dioxide may be more soluble in the oil than that of any other gas, which may improve performance of a SAGD/Drive/DHSG operation. The liquid state of carbon dioxide may be very beneficial in cooler reservoirs, such as those found under permafrost layers, with temperatures between about 45 to about 80 degrees Fahrenheit as indicated by the shaded strip 120 in FIG. 10.

While the foregoing is directed to embodiments of the invention, other and further embodiments of the invention may be devised without departing from the basic scope thereof, and the scope thereof is determined by the claims that follow.

What is claimed is:

1. A method for recovering hydrocarbons from a subterranean reservoir, comprising:

positioning a first device into a first horizontal well;

injecting a first fluid into the first horizontal well through the first device;

producing hydrocarbons from a second horizontal well disposed below the first well;

injecting a second fluid into a third well laterally offset from each of the first and second wells to drive fluids in the reservoir toward the second well while continuing to produce hydrocarbons from the second well;

establishing fluid communication between the first, second, and third wells;

increasing pressure in the first well by injecting the second fluid into the third well; and shutting in the first well when the pressure in the first well is increased by the second fluid to a pressure sufficient to maintain a drive operation for producing hydrocarbons from the second well.

2. The method of claim 1, wherein the first device is a downhole steam generator.

3. The method of claim 1, wherein the first fluid comprises steam.

4. The method of claim 3, wherein the first fluid further comprises one or both of carbon dioxide and oxygen.

5. The method of claim 1, wherein the second fluid comprises steam.

6. The method of claim 5, wherein the second fluid further comprises one or both of carbon dioxide and oxygen.

7. The method of claim 1, wherein the second fluid is injected into the third well by a second device.

8. The method of claim 1, further comprising generating carbon dioxide in the third well with a second device.

9. The method of claim 8, wherein the second device is a downhole steam generator.

10. The method of claim 1, further comprising selectively ceasing injection into the first well when the second well is in fluid communication with the third well and shutting in the first well when pressure in the first well reaches an initial injection pressure into the first well to maintain the drive operation.

11. The method of claim 1, further comprising selectively ceasing injection into the first well when the second well is in fluid communication with the third well and shutting in the first well when pressure in the first well increases above an initial injection pressure into the first well to maintain the drive operation.

12. The method of claim 1, further comprising increasing pressure in the first well when the second well is in fluid communication with the third well.

13. The method of claim 1, wherein the reservoir is disposed beneath a region comprising a layer of permafrost.

14. A method for recovering hydrocarbons from a subterranean reservoir, comprising:

injecting steam into a first horizontal well;

producing hydrocarbons from a second horizontal well disposed below the first well;

injecting steam, carbon dioxide, and oxygen into a third well laterally offset from each of the first and second wells while continuing to produce hydrocarbons from the second well;

establishing fluid communication between the first, second, and third wells;

increasing pressure in the first well by injecting at least one of the steam, carbon dioxide, and oxygen into the third well; and shutting in the first well when the pressure in the first well is increased by at least one of the steam, carbon dioxide, and oxygen to a pressure sufficient to maintain a drive operation for producing hydrocarbons from the second well.

15. The method of claim 14, further comprising selectively ceasing injection into the first well when the second well is in fluid communication with the third well and shutting in the first well when pressure in the first well reaches an initial injection pressure into the first well to maintain the drive operation.

16. The method of claim 14, further comprising selectively ceasing injection into the first well when the second well is in fluid communication with the third well and shutting in the first well when pressure in the first well increases above an initial injection pressure into the first well to maintain the drive operation.

17. The method of claim 14, wherein the steam is injected into the first well by a downhole steam generator.

18. The method of claim 14, wherein the steam, carbon dioxide, and oxygen are injected into the third well by a downhole steam generator.

19. The method of claim 14, further comprising injecting at least one of carbon dioxide and oxygen while injecting steam into the first well.

20. The method of claim 14, wherein at least one of carbon dioxide and steam is generated downhole in the third well by combustion of oil with the oxygen.

21. A method for recovering hydrocarbons from a subterranean reservoir, comprising:

positioning a first device into a first horizontal well;

injecting a first fluid at an initial pressure into the first horizontal well through the first device;

producing hydrocarbons from a second horizontal well disposed below the first well;

positioning a second device into a third well laterally offset from each of the first and second wells;

injecting a second fluid into the third well through the second device to drive fluids in the reservoir toward the second well while continuing to produce hydrocarbons from the second well;

establishing fluid communication between the first, second, and third wells;

increasing pressure in the first well by injecting the second fluid into the third well; and shutting in the first well when the pressure in the first well is increased by the second fluid to a pressure sufficient to maintain a drive operation for producing hydrocarbons from the second well.

22. The method of claim 21, wherein one or both of the first device and the second device is a downhole steam generator.

23. The method of claim 22, wherein the first fluid and the second fluid comprises steam.

24. The method of claim 23, wherein the first fluid further comprises one or both of carbon dioxide and oxygen.

25. A method for recovering hydrocarbons from a subterranean reservoir, comprising:

positioning a downhole steam generator into a first horizontal well;

injecting steam and one or both of carbon dioxide and oxygen into the first well through the downhole steam generator;

producing hydrocarbons from a second horizontal well disposed below the first well;

injecting a fluid into a third well laterally offset from each of the first and second wells to drive fluids in the reservoir toward the second well while continuing to produce hydrocarbons from the second well;

establishing fluid communication between the first, second, and third wells;

increasing pressure in the first well by injecting the fluid into the third well; and shutting in the first well when the pressure in the first well is increased by the fluid injected into the third well to a pressure sufficient to maintain a drive operation for producing hydrocarbons from the second well.

26. The method of claim 25, wherein the fluid comprises steam.

27. The method of claim 26, wherein the fluid further comprises one or both of carbon dioxide and oxygen.

28. The method of claim 25, wherein the fluid is injected into the third well by a downhole steam generator.

29. The method of claim 25, further comprising generating carbon dioxide in the third well with a downhole steam generator.

* * * * *